US006817906B2

(12) United States Patent
Zhou

(10) Patent No.: US 6,817,906 B2
(45) Date of Patent: Nov. 16, 2004

(54) ELECTRICAL CONNECTOR HAVING INDICATING FUNCTION

(75) Inventor: Min Zhou, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/404,336

(22) Filed: Mar. 31, 2003

(65) Prior Publication Data

US 2004/0175984 A1 Sep. 9, 2004

(30) Foreign Application Priority Data

Mar. 5, 2003 (TW) ..... 92203297 U

(51) Int. Cl.[7] ..... H01R 13/40
(52) U.S. Cl. ..... 439/752.5
(58) Field of Search ..... 439/752.5, 751, 439/733.1, 752, 76.1, 607, 79, 82, 83, 489–490, 676

(56) References Cited

U.S. PATENT DOCUMENTS 5,989,041 A * 11/1999 Lin ..... 439/79
6,299,461 B1 10/2001 Zhu et al.
6,302,748 B1 10/2001 Xu et al.
6,409,530 B1 6/2002 Zhao et al.
6,457,993 B1 10/2002 Espenshade
6,688,908 B2 * 2/2004 Wallace ..... 439/490
6,699,065 B1 * 3/2004 Espenshade et al. ..... 439/490

* cited by examiner

*Primary Examiner*—J. F. Duverne
(74) *Attorney, Agent, or Firm*—Wei Te Chung

(57) ABSTRACT

An electrical connector (1) includes a dielectric housing (10) defining a number of passageways (22) and a number of terminals (12) received in corresponding passageways. The terminals have a number of signal terminals (13) received in corresponding passageways of the dielectric housing, a grounding terminal (14) and a detecting terminal (15) for electrically connecting with an indicating unit of a printed circuit board (2). Each of the grounding terminal and the detecting terminal includes an engaging portion (27') for electrically connecting with a terminal of a complementary connector, a mounting portion (28') for electrically connecting with the PCB and a retaining portion (30') located between the engaging portion and the mounting portion. The grounding terminal and the detecting terminal are received in a common passageway of the dielectric housing and the engaging portions of these two terminals electrically connect with each other when the connector mates with a complementary connector.

11 Claims, 6 Drawing Sheets

ELECTRICAL CONNECTOR HAVING INDICATING FUNCTION

BACKGROUND OF THE INVENTION

1. Field of the Invention

The present invention relates to an electrical connector, and particularly to an electrical connector which can indicate an engaging status between the connector and a complementary connector.

2. Description of Related Art

Electrical connectors are widely used for signal transmission between personal computers and peripheral equipments, such as monitor and scanner. U.S. Pat. No. 6,299,461, issued to Zhu et al., discloses an electrical connector comprising a dielectric housing defining a plurality of passageways, a plurality of terminals received in the passageways and a fixing device securing the connector on a printed circuit board (PCB). Each terminal includes a front end positioned in the passageway for engaging with a terminal of a complementary connector and a rear end extending beyond the housing for soldering to the PCB. When the electrical connection between the connectors and the complementary connectors becomes faulty, there is a need to identify the fault duly and solve the problem immediately. Thus a connector providing a visual indication on faulty information regarding the electrical connection between the connector and the complementary connector is required.

U.S. Pat. No. 6,409,530, issued to Zhao et al., discloses a power jack comprising a spring contact, a switch contact and a Light Emitting Diode (LED) for indicating the engaging status between the power jack and a complementary plug. The spring contact, the switch contact and the LED are all electrically connected with a PCB on which the power jack is mounted. When the power jack engages with the plug, the spring contact is pressed down by a corresponding contact of the plug to disengage from the switch contact and an electrical path between the plug and the PCB is established, whereby the LED is on. Otherwise, the LED is off. However, in order to indicate the engaging status, the spring contact and the switch contact are employed, so this technology cannot adapt to a connector which includes a plurality of contacts.

U.S. Pat. No. 6,457,993, issued to Espenshade, discloses a modular jack comprising a pair of LEDs. The LEDs are multifunctional, such as indicating the engaging status between the modular jack and a complementary connector, indicating the working status of each terminal of the modular jack etc, so an electrical circuit on a PCB on which the modular jack is mounted for connecting with the LEDs is complicated. However, sometimes only a connector capable of indicating the engaging status of connecting to a complementary connector is desired, so it is not necessary to make the PCB so complicated.

Hence, an electrical connector having an improved indicating device is desired to overcome the disadvantages and problems of the prior art.

SUMMARY OF THE INVENTION

A main object of the present invention is to provide an electrical connector having a detecting terminal for indicating the engaging status between the connector and a complementary connector.

To achieve the above object, an electrical connector in accordance with the present invention comprises a dielectric housing defining a plurality of passageways, a plurality of signal terminals received in corresponding passageways of the dielectric housing, a grounding terminal and a detecting terminal for electrically connecting with an indicating unit of a printed circuit board (PCB). The grounding terminal and the detecting terminal are received in a corresponding passageway of the dielectric housing and electrically insulated with each other. Each of the grounding terminal and the detecting terminal comprises an engaging portion for electrically connecting with a terminal of the complementary connector, a mounting portion for electrically connecting with the PCB and a retaining portion located between the engaging portion and the mounting portion. The grounding terminal and the detecting terminal are engageable with the terminal of the complementary connector to establish an electrical connection therebetween.

Other objects, advantages and novel features of the invention will become more apparent from the following detailed description when taken in conjunction with the accompanying drawings.

DETAILED DESCRIPTION OF THE INVENTION

Figure 1:
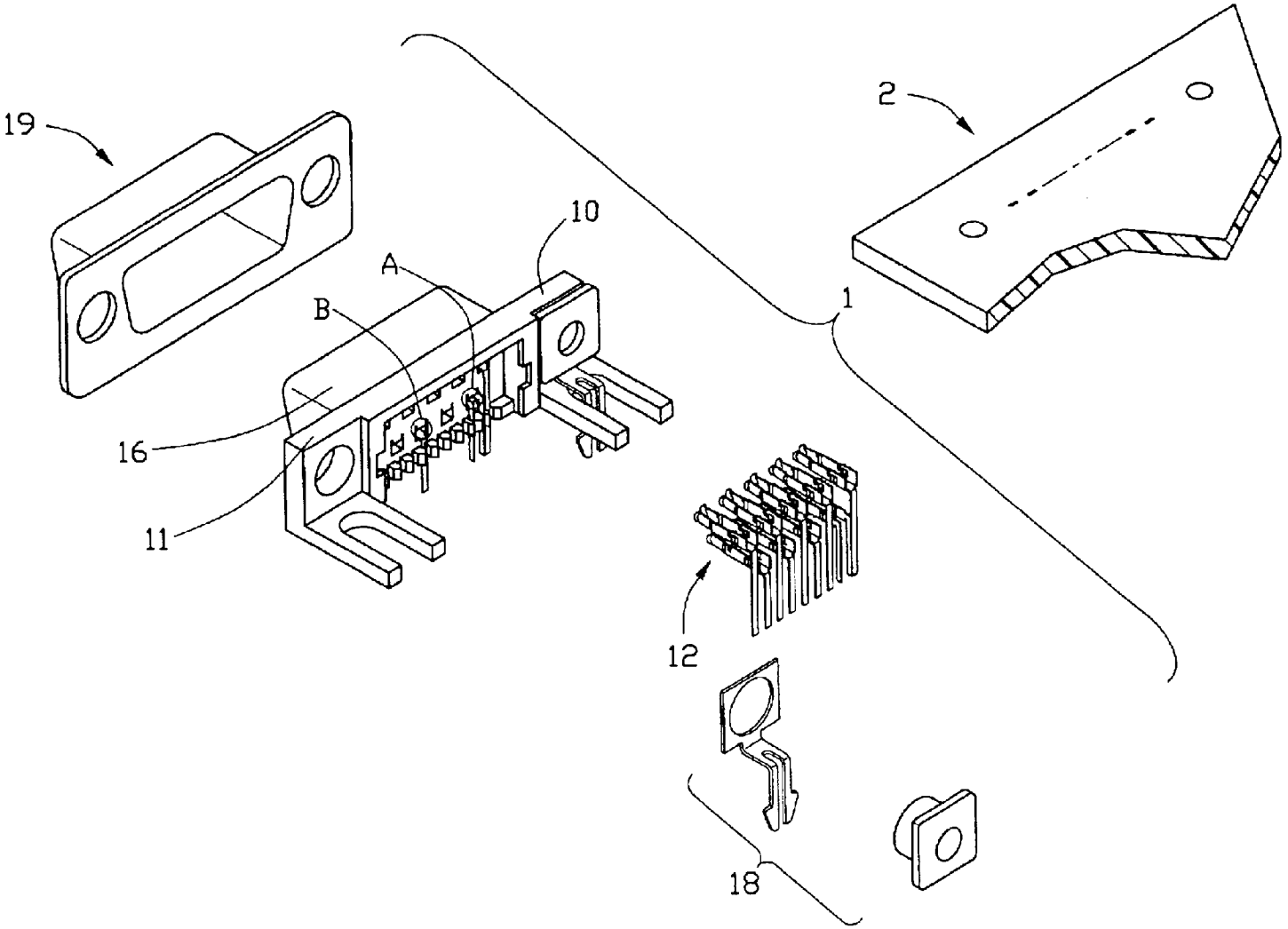
FIG. 1 is a partially exploded perspective view of an electrical connector in accordance with the present invention and a printed circuit board (PCB) on which the connector is mounted.

Referring to FIG. 1, an electrical connector 1 in accordance with the present invention comprises a dielectric housing 10, a plurality of terminals 12 received in the dielectric housing 10, a shield 19 attached to the dielectric housing 10 and a lock device 18 for mounting the connector 1 onto a printed circuit board (PCB) 2.

Figure 2:
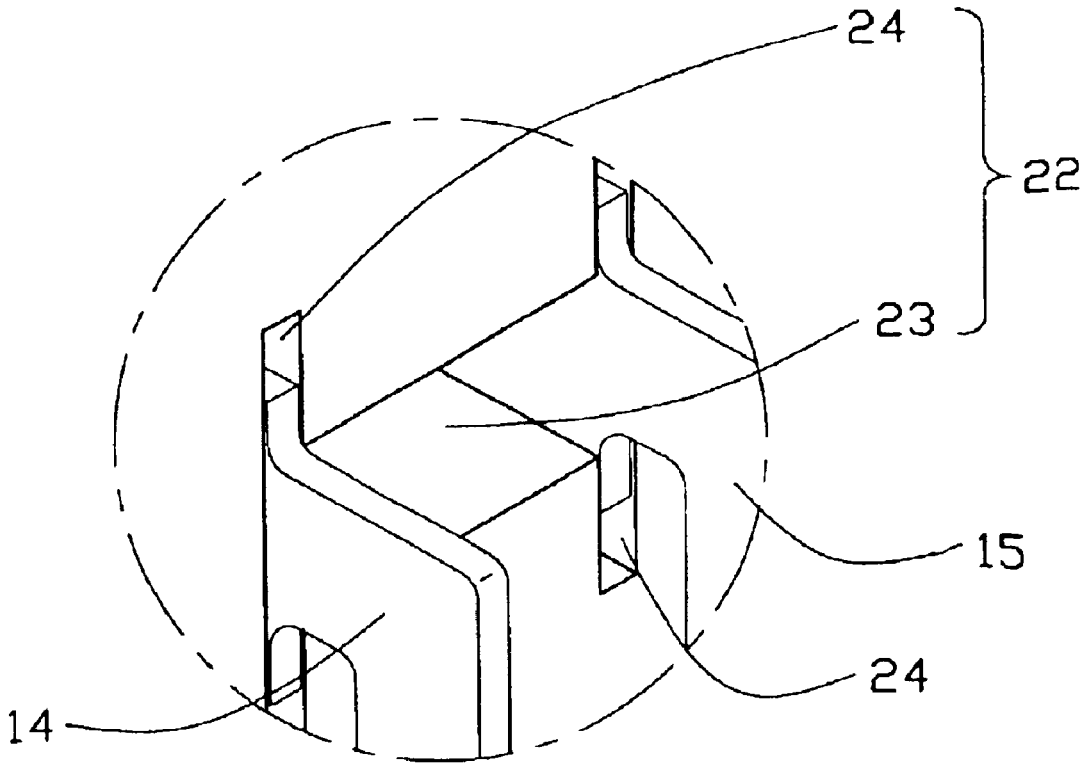
FIG. 2 is an enlarged perspective view taken from a circle A of FIG. 1.
Figure 3:
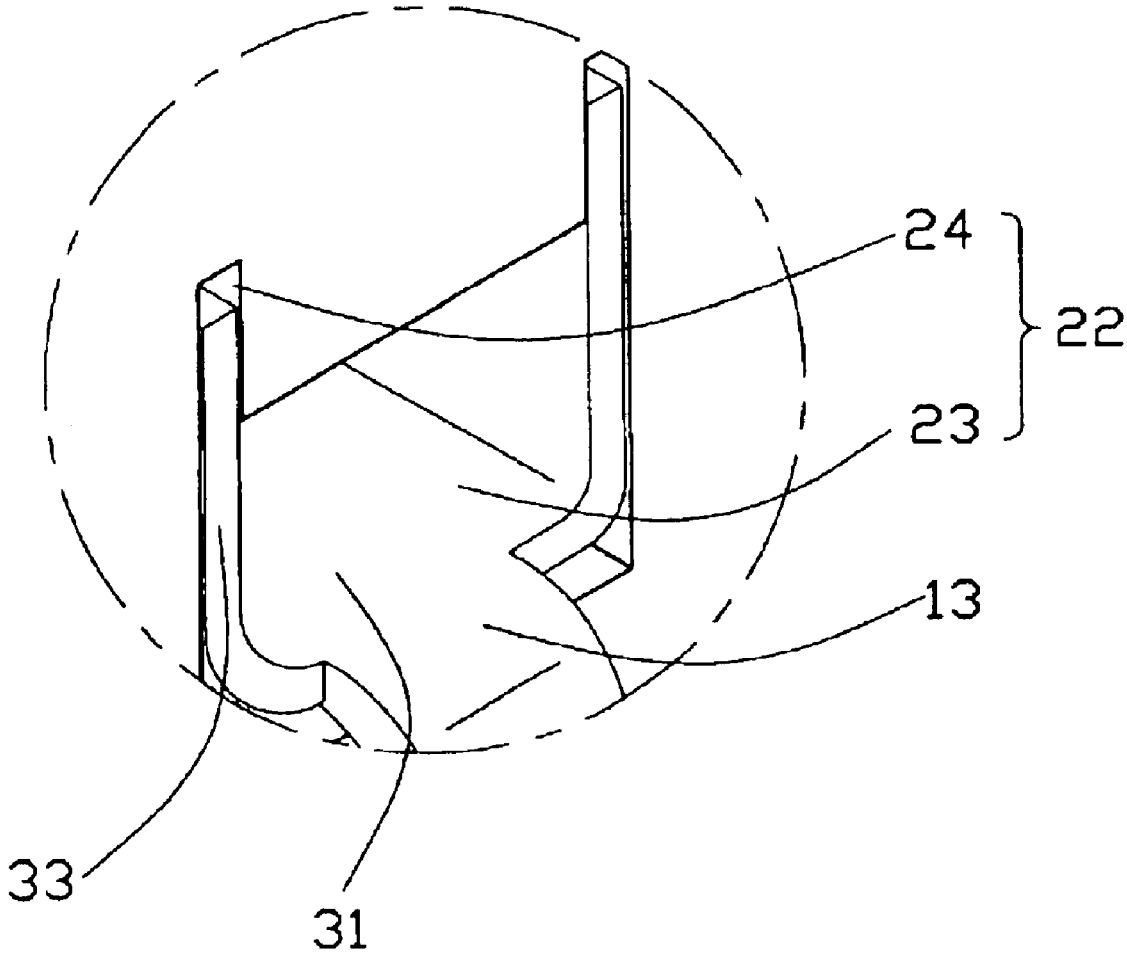
FIG. 3 is an enlarged perspective view taken from a circle B of FIG. 1.

Referring to FIGS. 2–3 and in conjunction with FIG. 1, the dielectric housing 10 comprises a base portion 11, a tongue portion 16 extending forwardly from the base portion 11 and a plurality of passageways 22 extending through the base portion 11 and the tongue portion 16. Each passageway 22 comprises a central slot 23 and a pair of side guiding slits 24 communicating with the central slot 23.

Figure 4:
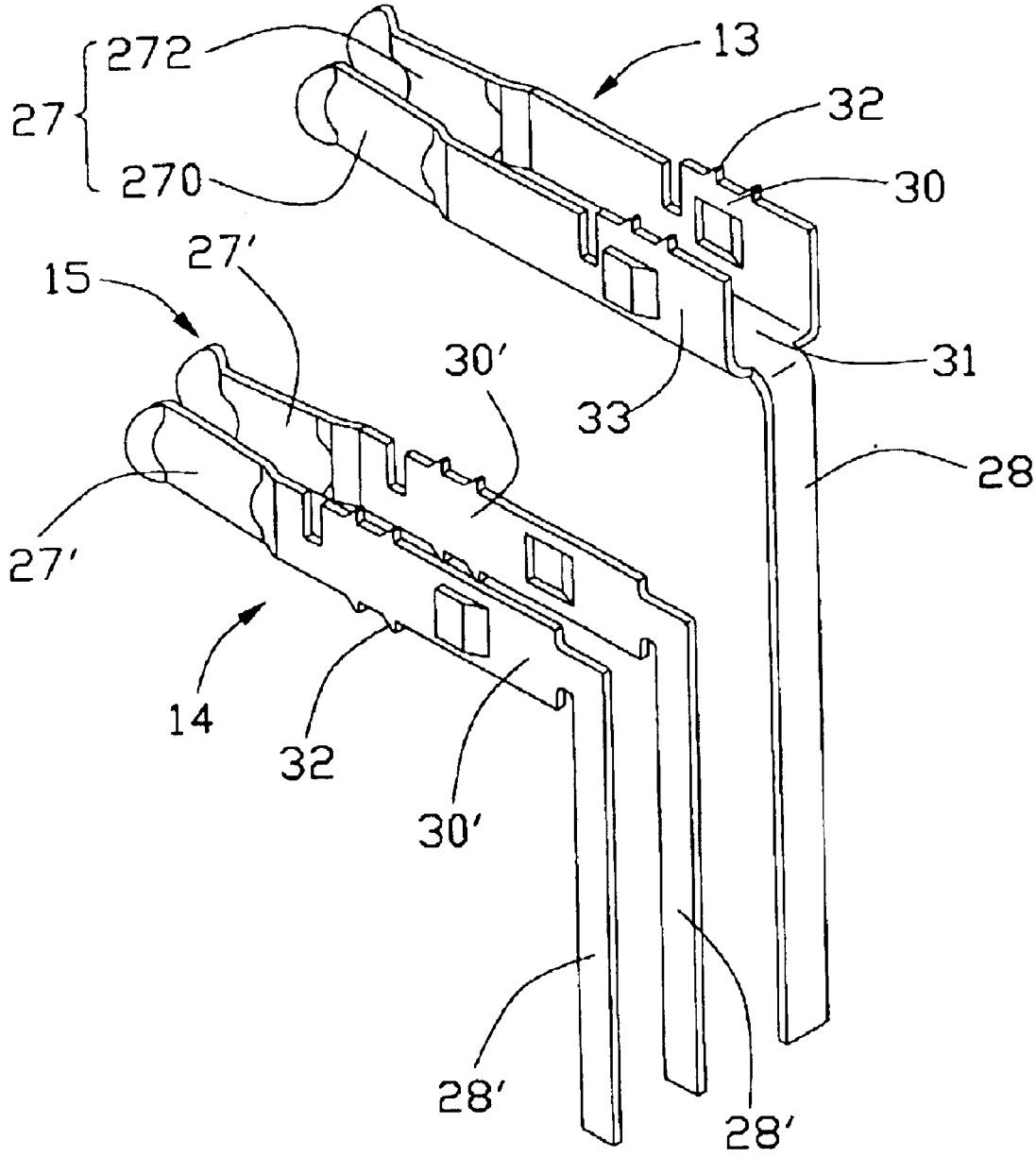
FIG. 4 is an enlarged perspective view of a signal terminal, a grounding terminal and a detecting terminal shown in FIG. 1.

Referring to FIGS. 1 and 4, the terminals 12 are made of metal materials and comprise a plurality of signal terminals 13 for signal transmission, a grounding terminal 14 for electrically connecting with a ground circuit of the PCB and a detecting terminal 15 for electrically connecting an indicating unit (schematically shown in FIG. 6) of the PCB.

Each signal terminal 13 comprises an engaging portion 27, a mounting portion 28 and a U-shaped retaining portion 30 interconnecting the engaging portions 27 with the mounting portion 28. The retaining portion 30 includes a pair of parallel side arms 33 and an intermediate plate 31 connecting the parallel side arms 33 together. Each side arm 33 is formed with a plurality of barbs 32 on an upper end thereof for being interferentially received in the corresponding guide slit 24. The engaging portion 27 comprises a first and a second sections 270,272 extending forwardly and inwardly from front ends of the side arms 33, respectively. The mounting portion 28 extends downwardly and perpendicularly from a rear end of the intermediate plate 31.

The grounding terminal 14 and the detecting terminal 15 are symmetrically arranged and each of these two terminals comprises a retaining portion 30' retained in the corresponding guide slit 24, an engaging portion 27' extending forwardly from a front end of the retaining portion 30 and a mounting portion 28' extending downwardly and perpendicularly from a rear end of the retaining portion 30'. The engaging portion 27' is similar to the first or the second section 270,272 of the engaging portion 27 of the signal terminal 13 in structure. The retaining portion 30' defines a plurality of barbs 32 on top and bottom ends thereof for being interferentially retained in the corresponding guide slit 24.

Referring back to FIGS. 2–3, the signal terminals 13 are received in the corresponding passageways 22 with the retaining portions 30 interferentially retained in the corresponding guiding slits 24. The grounding terminal 14 and the detecting terminal 15 are together received in a corresponding passageway 22 with the retaining portions 30' interferentially retained in the corresponding guiding slits 24. The grounding terminal 14 and the detecting terminal 15 are adapted from one signal terminal 13, so it is not necessary to change the structure of the complementary connector.

Figure 5:
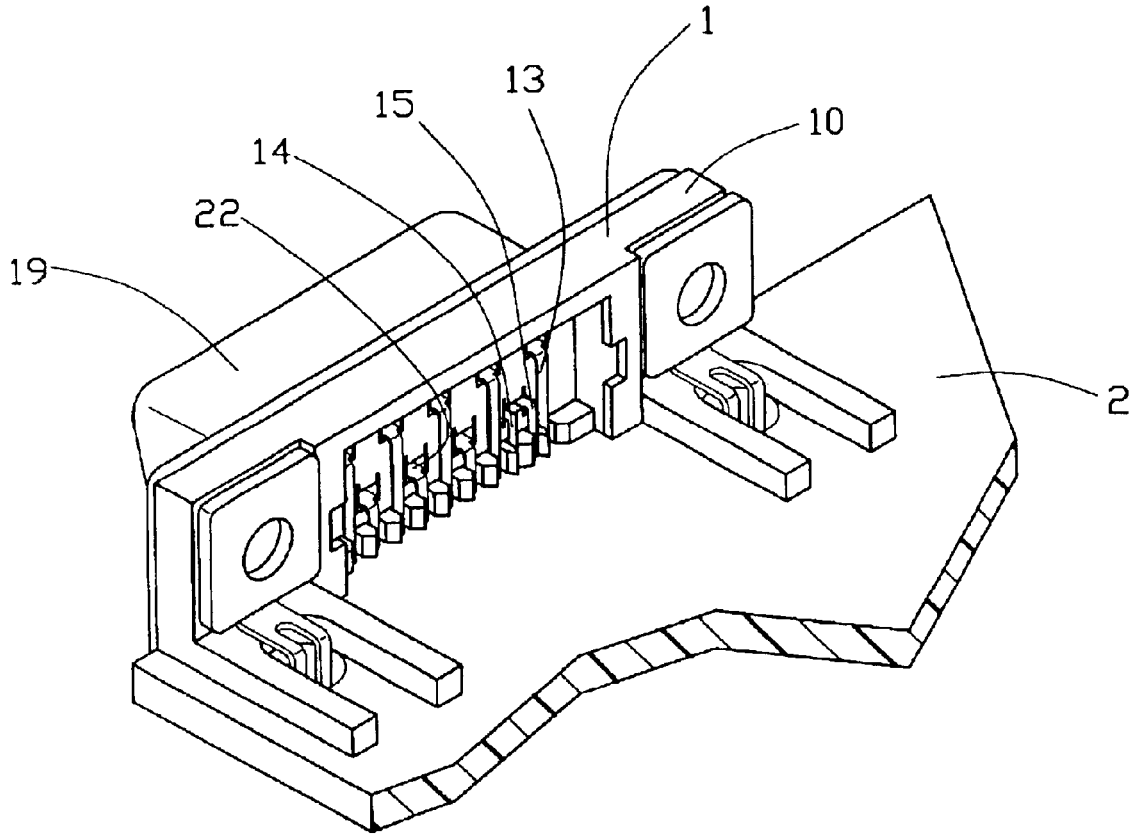
FIG. 5 is an assembled perspective view of the electrical connector of FIG. 1, showing the connector being mounted on the PCB.
Figure 6:
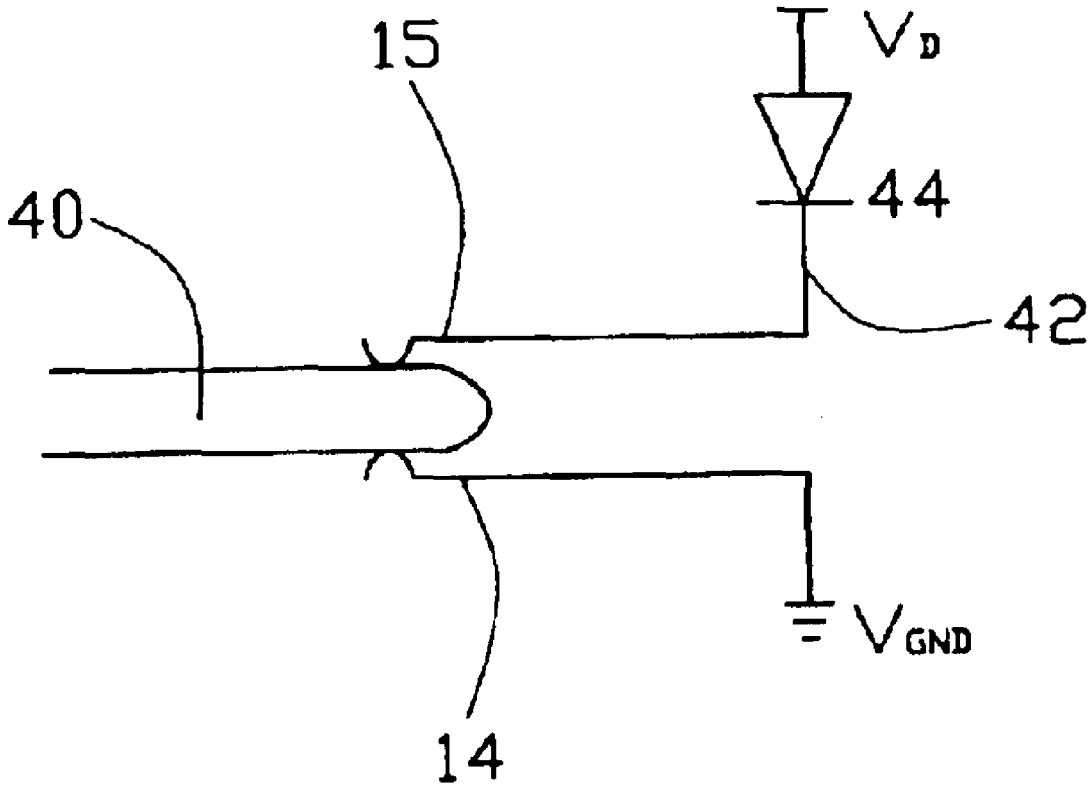
FIG. 6 is a schematic view showing the connector electrically connecting with an indicating unit of the PCB.

Referring to FIGS. 5–6, when the connector 1 is mounted on the PCB 2, the mounting portion 28' of the grounding terminal 14 is electrically connected with a grounding circuit of the PCB 2, the mounting portion 28' of the detecting terminal 15 is electrically connected with the indicating unit of the PCB 2. The indicating unit comprises an electrical circuit path 42 in electrical connection with the detecting terminal and a Light Emitting Diode (LED) 44 equipped on the PCB 2, a voltage source VD for supplying power to the LED 44 in the electrical circuit path 42. The LED is electrically connected with the electrical circuit path 42 and the voltage source VD. When the connector 1 engages with a complementary connector (not shown), the engaging portions 27' of the grounding terminal 14 and the detecting terminal 15 are electrically connected with each other by respectively contacting with a terminal 40 of the complementary connector, whereby an electrical path is established in the indicating unit, thus the LED 44 is on. When the connector 1 disengages from the complementary connector, the engaging portions 27' of the grounding terminal 14 and the detecting terminal 15 are disconnected from each other, the electrical circuit 42 in the indicating unit is switch off, the LED 44 is out. Therefore, we can identify the engaging status between the connector 1 and the complementary connector from whether the LED lights on or not.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being mounted on a printed circuit board (PCB) and adapted for engaging with a complementary connector, comprising:

a dielectric housing defining a plurality of passageways;

a plurality of first terminals received in corresponding passageways of the dielectric housing; and a second terminal and a third terminal received in a corresponding passageway of the dielectric housing and electrically insulated from each other, the third terminal being adapted for electrically connecting with an indicating unit of the PCB, each of the second terminal and the third terminal comprising an engaging portion adapted for electrically connecting with a terminal of the complementary connector, a mounting portion adapted for electrically connecting with the PCB and a retaining portion located between the engaging portion and the mounting portion, the second terminal and the third terminal being engageable with the terminal of the complementary connector to establish an electrical connection therebetween; wherein the engaging portions of the second terminal and the third terminal extend forwardly and inwardly from the retaining portions and are arranged in a mirror-imaged manner; wherein each of the first terminals comprises an engaging portion comprising a first section and as second section, and wherein the engaging portions of the second and the third terminals are similar to the first and the second section of the engaging portion of the first terminal, respectively; wherein the third terminal is a detecting terminal indicating an engaging status between the connector and the complementary connector.

2. The electrical connector as claimed in claim 1, wherein the second terminal is a grounding terminal.

3. The electrical connector as claimed in claim 1, wherein the retaining portions of the second terminal and the third terminal comprise a plurality of barbs to retain the second and the third terminals in the dielectric housing.

4. The electrical connector as claimed in claim 1, wherein each passageway comprises a pair of separated guiding slits, and wherein the retaining portions of the second and the third terminals are interferentially fitted in the guiding slits, respectively.

5. The electrical connector as claimed in claim 1, wherein the mounting portions of the second terminal and the third terminal extend perpendicularly and downwardly from the retaining portions of the second terminal and the third terminal, respectively.

6. An electrical connector assembly comprising:

a printed circuit board (PCB) comprising an indicating unit;

a dielectric housing defining a plurality of passageways;

a plurality of first terminals received in corresponding passageways of the dielectric housing; and a second terminal and a third terminal received in a passageway of the dielectric housing, the third terminal electrically connecting with the indicating unit of the PCB, each of the second terminal and the third terminal comprising an engaging portion adapted for electrically connecting with a terminal of a complementary connector, a mounting portion electrically connecting with the PCB and a retaining portion located between the engaging portion and the mounting portion, the second and the third terminals being engageable the terminal of the complementary connector to establish a electrical connection therebetween; wherein the engaging portions of the second terminal and the third terminal extend forwardly and inwardly from the retaining portions and are arranged in a mirror-imaged manner; wherein each of the first terminals comprises an engaging portion comprising first section and a second section, and wherein the engaging portions of the second and the third terminals are similar to the first and the second section of the engaging portion of the first terminal, respectively, wherein the third terminal is a detecting terminal indicating an engaging status between the connector assembly and the complementary connector.

7. The electrical connector assembly as claimed in claim 6, wherein the indicating unit comprises an electrical circuit path in electrical connection with the third terminal and a Light Emitting Diode (LED), a voltage source supplying power to the LED in the electrical circuit path.

8. The electrical connector assembly as claimed in claim 6, wherein the second terminal is a grounding terminal.

9. The electrical connector assembly as claimed in claim 6, wherein the retaining portions of the second terminal and the third terminal comprise a plurality of barbs to retain the second and the third terminals in the dielectric housing.

10. The electrical connector assembly as claimed in claim 6, wherein each passageway comprises a pair of separated guiding slits, and wherein the retaining portions of the second and the third terminals are interferentially fitted in the guiding slits, respectively.

11. The electrical connector assembly as claimed in claim 6, wherein the mounting portions of the third terminal and the second terminal extend perpendicularly downwardly from the retaining portions of the second and the third terminals, respectively.

* * * * *